US011317709B1

(12) United States Patent
Khalili et al.

(10) Patent No.: US 11,317,709 B1
(45) Date of Patent: May 3, 2022

(54) DISPOSABLE TOOTHPASTE-DISPENSING TOOTHBRUSH

(71) Applicants: Suzanne Khalili, Huntington Park, CA (US); Sandra Khalili, Huntington Park, CA (US); Jasmine Newman, Huntington Park, CA (US)

(72) Inventors: Suzanne Khalili, Huntington Park, CA (US); Sandra Khalili, Huntington Park, CA (US); Jasmine Newman, Huntington Park, CA (US)

( * ) Notice: Subject to any disclaimer, the term of this patent is extended or adjusted under 35 U.S.C. 154(b) by 0 days.

(21) Appl. No.: 17/114,666

(22) Filed: Dec. 8, 2020

(51) Int. Cl.
*A46B 11/00* (2006.01)

(52) U.S. Cl.
CPC ..... *A46B 11/0027* (2013.01); *A46B 11/0003* (2013.01); *A46B 11/0065* (2013.01); *A46B 11/0089* (2013.01); *A46B 11/0024* (2013.01); *A46B 2200/1066* (2013.01)

(58) Field of Classification Search
CPC ... A46B 11/00; A46B 11/001; A46B 11/0017; A46B 11/002; A46B 11/0024; A46B 11/0027; A46B 11/0072; A46B 11/0065; A46B 11/0003; A46B 11/0089; A46B 2200/1066; B65D 83/0005; B65D 83/0011
USPC ..... 401/268, 270, 277, 279, 282, 171–175
See application file for complete search history.

(56) References Cited

U.S. PATENT DOCUMENTS

| | | | | |
|---|---|---|---|---|
| 4,149,552 | A | 4/1979 | Stewmon | |
| 4,332,497 | A | 6/1982 | Rodriguez | |
| 5,100,252 | A * | 3/1992 | Podolsky | A46B 11/0027 401/174 |
| D375,407 | S | 11/1996 | Smith | |
| 5,842,487 | A | 12/1998 | Ledet | |
| 5,927,889 | A | 7/1999 | La Flower | |
| 6,009,886 | A * | 1/2000 | Labranche | A46B 11/0027 132/308 |
| 6,334,451 | B1 | 1/2002 | Kang | |
| 2003/0215282 | A1 | 11/2003 | Edwards | |
| 2004/0057773 | A1 | 3/2004 | Gray | |
| 2004/0154635 | A1 | 8/2004 | Segura | |
| 2010/0132145 | A1 | 6/2010 | Minto | |

FOREIGN PATENT DOCUMENTS

| | | |
|---|---|---|
| WO | 9856277 | 12/1998 |

* cited by examiner

*Primary Examiner* — David J Walczak
(74) *Attorney, Agent, or Firm* — Kyle A. Fletcher, Esq.

(57) ABSTRACT

The disposable toothpaste-dispensing toothbrush is a toothbrush. The disposable toothpaste-dispensing toothbrush is configured for use in brushing the teeth of a patient. The disposable toothpaste-dispensing toothbrush is a disposable structure. The disposable toothpaste-dispensing toothbrush contains a toothpaste. The disposable toothpaste-dispensing toothbrush dispenses the toothpaste before the use of the disposable toothpaste-dispensing toothbrush. The disposable toothpaste-dispensing toothbrush comprises a brush structure and a protective housing. The protective housing encloses the brush structure. The brush structure: a) contains the toothpaste; b) dispenses the toothpaste; and, c) generates an abrasion used to clean the teeth of the patient.

19 Claims, 5 Drawing Sheets

DISPOSABLE TOOTHPASTE-DISPENSING TOOTHBRUSH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushware and brushes including brushes with reservoirs, more specifically, a brush with a reservoir that is manually powered with a piston.

Summary of Invention

The disposable toothpaste-dispensing toothbrush is a toothbrush. The disposable toothpaste-dispensing toothbrush is configured for use in brushing the teeth of a patient. The disposable toothpaste-dispensing toothbrush is a disposable structure. The disposable toothpaste-dispensing toothbrush contains a toothpaste. The disposable toothpaste-dispensing toothbrush dispenses the toothpaste before the use of the disposable toothpaste-dispensing toothbrush. The disposable toothpaste-dispensing toothbrush comprises a brush structure and a protective housing. The protective housing encloses the brush structure. The brush structure: a) contains the toothpaste; b) dispenses the toothpaste; and, c) generates an abrasion used to clean the teeth of the patient.

These together with additional objects, features and advantages of the disposable toothpaste-dispensing toothbrush will be readily apparent to those of ordinary skill in the art upon reading the following detailed description of the presently preferred, but nonetheless illustrative, embodiments when taken in conjunction with the accompanying drawings.

In this respect, before explaining the current embodiments of the disposable toothpaste-dispensing toothbrush in detail, it is to be understood that the disposable toothpaste-dispensing toothbrush is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the disposable toothpaste-dispensing toothbrush.

It is therefore important that the claims be regarded as including such equivalent construction insofar as they do not depart from the spirit and scope of the disposable toothpaste-dispensing toothbrush. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
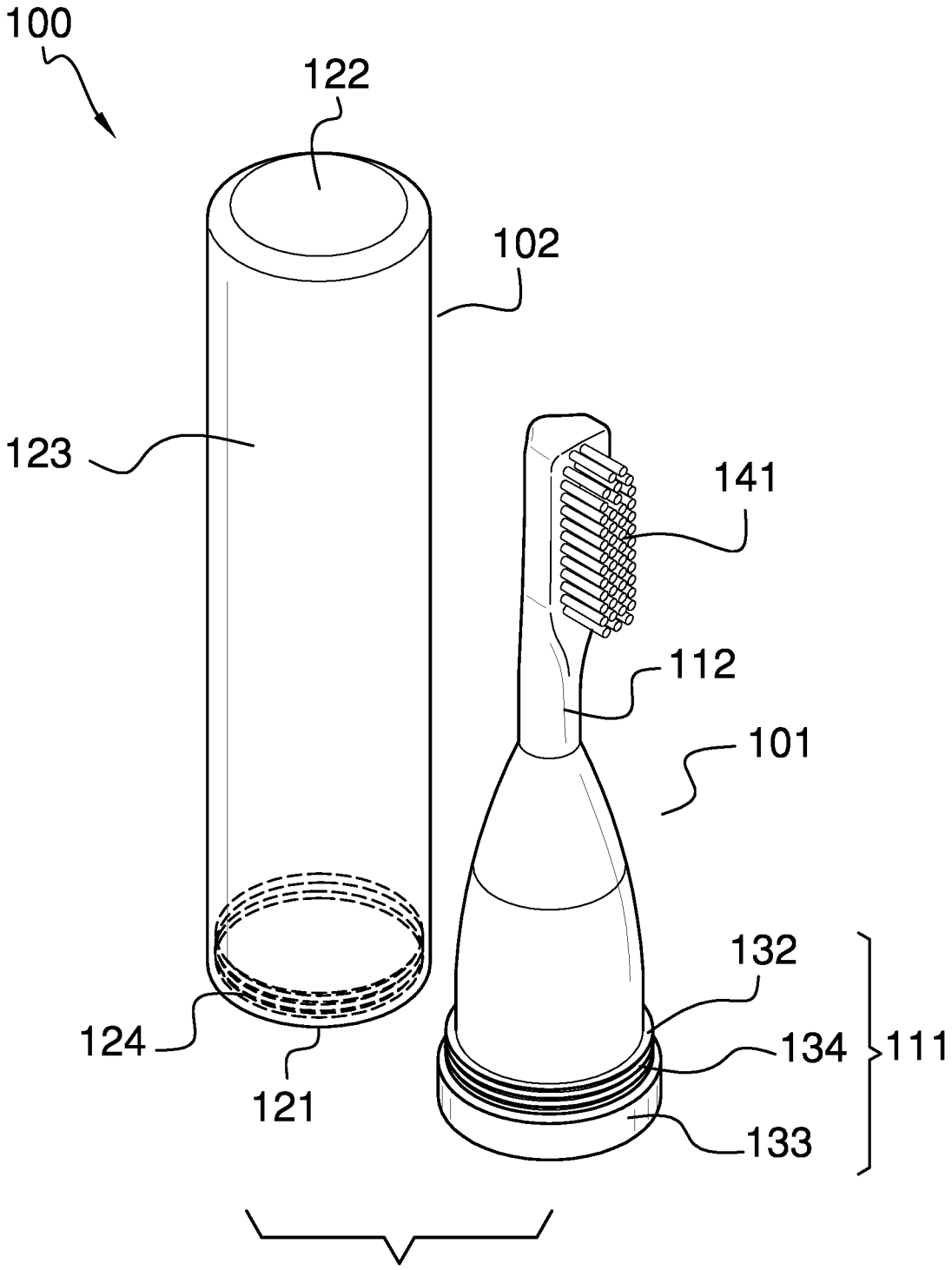
FIG. 1 is a perspective view of an embodiment of the disclosure.
Figure 2:
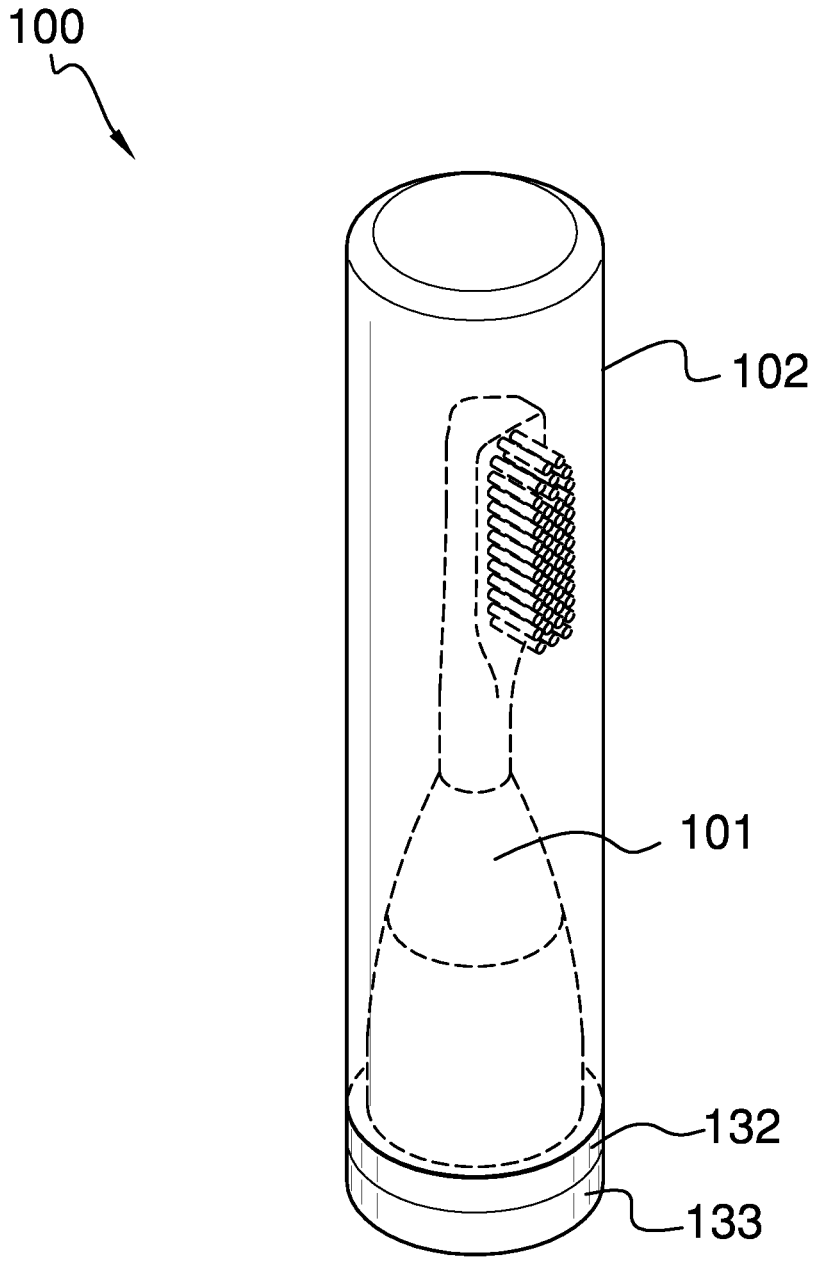
FIG. 2 is a perspective view of an embodiment of the disclosure.
Figure 3:
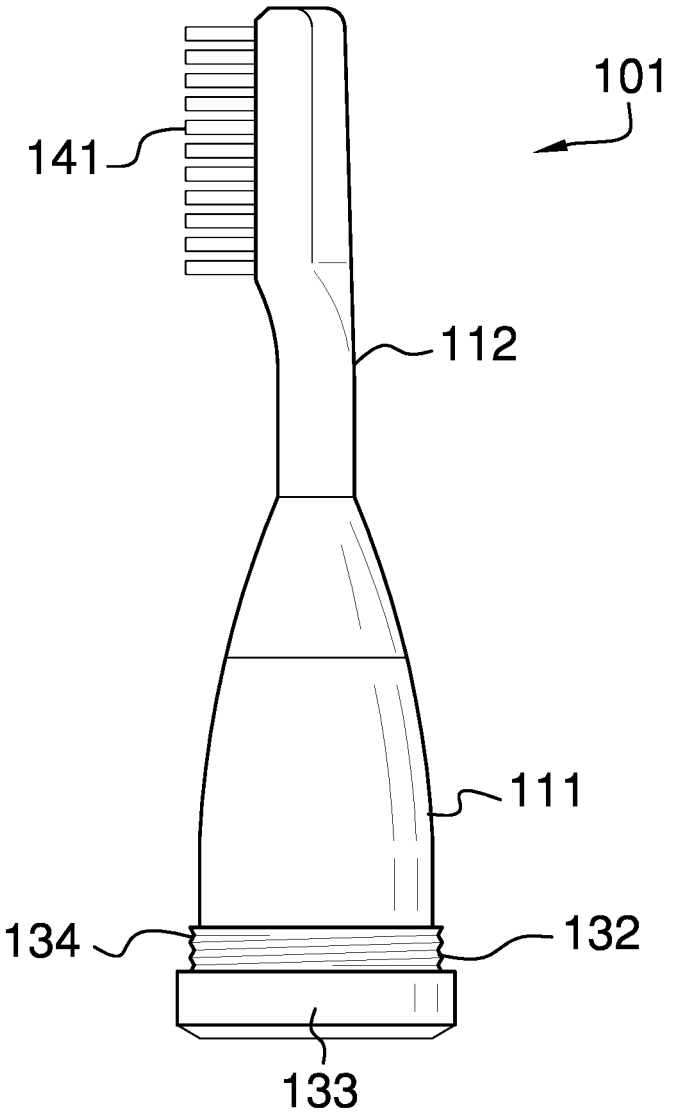
FIG. 3 is a side view of an embodiment of the disclosure.
Figure 4:
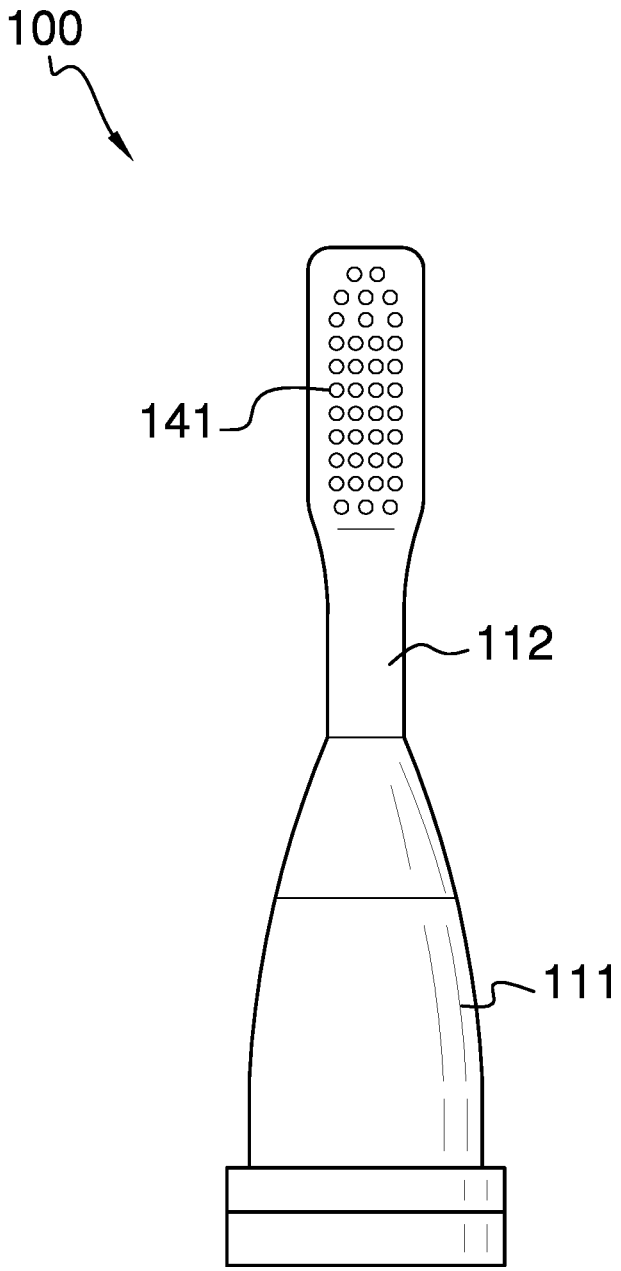
FIG. 4 is a front view of an embodiment of the disclosure.
Figure 5:
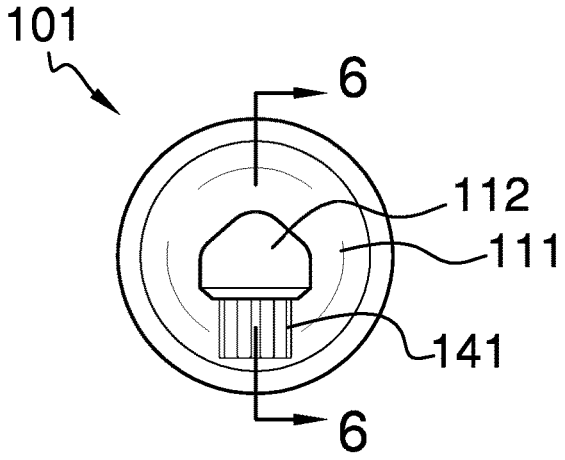
FIG. 5 is a top view of an embodiment of the disclosure.
Figure 6:
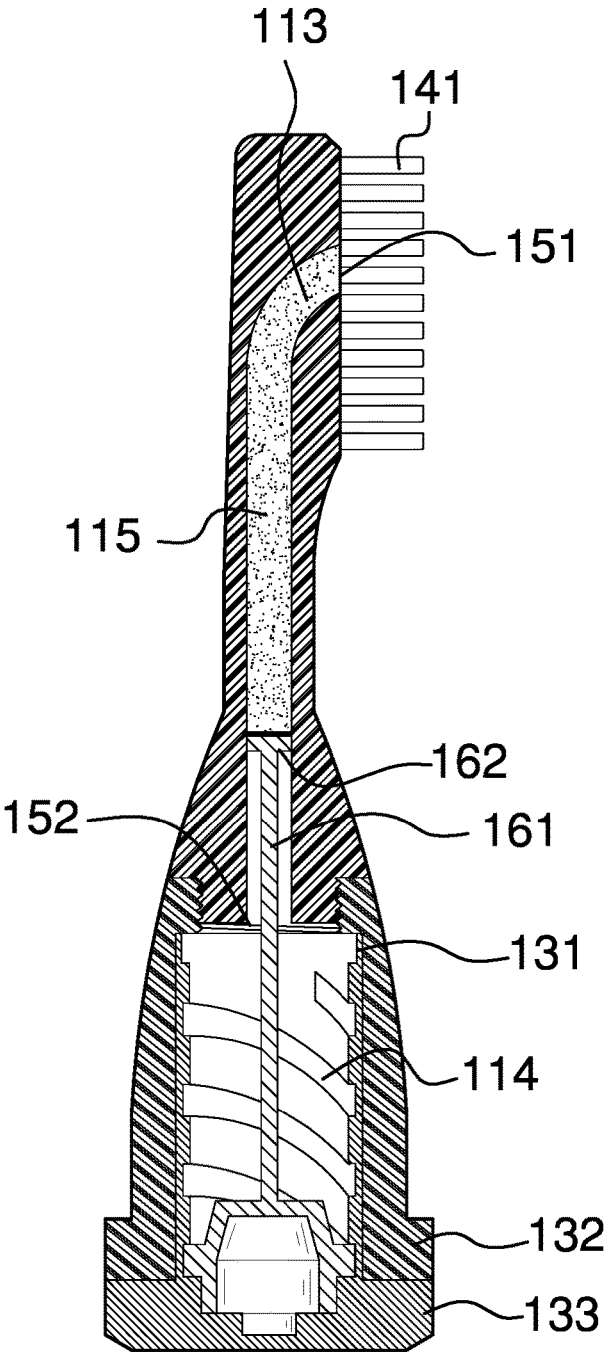
FIG. 6 is a cross-sectional view of an embodiment of the disclosure across 6-6 as shown in FIG. 5.

Detailed reference will now be made to one or more potential embodiments of the disclosure, which are illustrated in FIGS. 1 through 6.

The disposable toothpaste-dispensing toothbrush 100 (hereinafter invention) is a toothbrush. The invention 100 is configured for use in brushing the teeth of a patient. The invention 100 is a disposable structure. The invention 100 contains a toothpaste 115. The invention 100 dispenses the toothpaste 115 before the use of the invention 100. The invention 100 comprises a brush structure 101 and a protective housing 102. The protective housing 102 encloses the brush structure 101. The brush structure 101: a) contains the toothpaste 115; b) dispenses the toothpaste 115; and, c) generates an abrasion used to clean the teeth of the patient. The toothpaste 115 is a cleaning agent used to clean the teeth of the patient. The toothpaste 115 is defined elsewhere in this disclosure.

The brush structure 101 is a mechanical structure. The brush structure 101 is a disposable structure. The brush structure 101 has a composite prism structure. The brush structure 101 stores the toothpaste 115. The brush structure 101 dispenses the toothpaste 115 on to a brush head 141. The brush structure 101 forms an abrasive structure used to clean the teeth of the patient. The brush structure 101 comprises a tapered prism structure 111, an extension structure 112, a spline 113, a worm drive 114, and a toothpaste 115.

The tapered prism structure 111 is a mechanical structure. The tapered prism structure 111 is defined elsewhere in this disclosure. The tapered prism structure 111 is a hollow structure. The tapered prism structure 111 forms the grip used to hold and manipulate the brush structure 101. The tapered prism structure 111 contains the worm drive 114. The tapered prism structure 111 contains a portion of the spline 113. The tapered prism structure 111 comprises a worm drive 114 cylinder 131, a pedestal 132, and a dial 133.

The worm drive 114 cylinder 131 is a negative space that is formed in the tapered prism structure 111. The worm drive 114 cylinder 131 contains the worm drive 114 within the tapered prism structure 111. The worm drive 114 cylinder 131 is formed with any helical structures required for the operation of the specific instantiation of the worm drive 114.

The pedestal 132 is a rim structure. The pedestal 132 is formed at the congruent end of the tapered prism structure 111 with the greater radial diameter. The pedestal 132 forms a stable base that is placed of a supporting surface. The stable base formed by the pedestal 132 prevents the brush structure 101 from tipping over. The pedestal 132 further comprises an exterior screw thread 134. The exterior screw thread 134 is a helical structure that is formed on the exterior surface of the pedestal 132. The exterior screw thread 134 secures the brush structure 101 into the protective housing 102. The operation of the exterior screw thread 134 is described elsewhere in this disclosure.

The dial 133 is a rotating structure. The dial 133 attaches to the pedestal 132 such that the dial 133 rotates relative to the pedestal 132. The dial 133 physically attaches to the worm drive 114 such that the rotation of the dial 133 rotates the worm drive 114. The dial 133 provides the motive forces that are required to operate the worm drive 114.

The extension structure 112 is a prism-shaped structure. The spline 113 is defined elsewhere in this disclosure. The extension structure 112 attaches to the tapered prism structure 111 to form a composite prism structure. The extension structure 112 attaches to the congruent end of the tapered prism structure 111 with the lesser radial diameter. The extension structure 112 presents the brush head 141 for use. The extension structure 112 forms the reach between the tapered prism structure 111 and the brush head 141. The extension structure 112 contains a portion of the spline 113. The extension structure 112 comprises a brush head 141. The brush head 141 is a brush. The brush head 141 attaches to the exterior of the extension structure 112. The position of the brush head 141 is at a location that is distal from the tapered prism structure 111 of the brush structure 101. The brush head 141 forms the abrasive structure use to clean the teeth of the patient.

The spline 113 is a continuous negative space that is formed in the interiors of both the tapered prism structure 111 and the extension structure 112. The spline 113 is defined elsewhere in this disclosure. The spline 113 is a non-Euclidean prism structure. The spline 113 forms a non-Euclidean tubular structure that stores the toothpaste 115 within the brush structure 101. The spline 113 transports the toothpaste 115 to the brush head 141 of the extension structure 112. The spline 113 discharges the toothpaste 115 into the brush head 141. The spline 113 comprises a brush head 141 aperture 151 and a worm drive 114 aperture 152.

The brush head 141 aperture 151 forms an open end of the non-Euclidean tubular structure of the spline 113. The brush head 141 aperture 151 forms the port through which the toothpaste 115 is discharged from the spline 113 by the worm drive 114. The worm drive 114 aperture 152 forms an open end of the non-Euclidean tubular structure of the spline 113. The worm drive 114 aperture 152 forms the port that allows the drive shaft 161 to insert into the spline 113. The worm drive 114 aperture 152 is sized such that the drive shaft 161 can move linearly into and out of the negative space formed by the spline 113.

The worm drive 114 is a mechanical structure. The worm drive 114 is defined elsewhere in this disclosure. The worm drive 114 converts rotational motion into linear motion. The worm drive 114 provides the motive forces that push the toothpaste 115 out of the spline 113 into the brush head 141. The worm drive 114 comprises a drive shaft 161 and a piston 162.

The drive shaft 161 is a prism-shaped structure. The drive shaft 161 forms a shaft that physically connects to the worm drive 114. The rotation of the worm drive 114 by the dial 133 of the tapered prism structure 111 generates a linear motion that moves the drive shaft 161 into and out of the spline 113. The drive shaft 161 inserts into the spline 113 such that the center axes of the drive shaft 161 and the spline 113 are aligned. The drive shaft 161 is formed as a bimodal flexible structure that allows the drive shaft 161 to: a) transfer a motive force to the piston 162; while, b) simultaneously allowing the center axis of the drive shaft 161 to adjust to changes in the center axis of the non-Euclidean structure of the spline 113. The bimodal flexible structure is defined elsewhere in this disclosure.

The piston 162 is a disk-shaped structure. The piston 162 is a rigid structure. The piston 162 attaches to the congruent end of the drive shaft 161 that is distal from the worm drive 114. The piston 162 and the worm drive 114 join to form a composite prism structure. The piston 162 is geometrically similar to the spline 113. The face of the disk structure of the piston 162 inserts into the spline 113 such that the congruent ends of the disk structure of the piston 162 are perpendicular to the center axis of the spline 113.

The bimodal flexible structure of the drive shaft 161 adjusts the position of the congruent ends of the disk structure of the piston 162 such that the congruent ends of the piston 162 remain perpendicular to the center axis of the spline 113 as the toothpaste 115 is discharged from the spline 113. The motion of the piston 162 within the spline 113 applies a pressure against the toothpaste 115 that pushes the toothpaste 115 out of the brush head 141 aperture 151 of the spline 113. The piston 162 is formed such that there is a tight fit between the piston 162 and the interior walls of the spline 113.

The protective housing 102 is a mechanical structure. The protective housing 102 forms a protected space used to enclose the brush head 141 of the brush structure 101. The protective housing 102 is a prism-shaped structure. The protective housing 102 has a tube structure. The protective housing 102 has a pan structure. The brush structure 101 inserts into the open congruent end 121 of the pan structure of the protective housing 102 for storage. The protective housing 102 comprises an open congruent end 121, a closed congruent end 122, and a lateral face 123.

The open congruent end 121 is the open end of the pan structure of the protective housing 102. The open congruent end 121 is sized such that the brush structure 101 fully inserts into the protective housing 102 through the open congruent end 121.

The closed congruent end 122 is the closed end of the pan structure of the protective housing 102. The closed congruent end 122 forms a containment boundary of the pan structure of the protective housing 102. The closed congruent end 122 is the end of the protective housing 102 that is distal from the open congruent end 121.

The lateral face 123 is the lateral face 123 of the pan structure of the protective housing 102. The lateral face 123 forms a containment boundary of the pan structure of the protective housing 102. The lateral face 123 further comprises an interior screw thread 124. The interior screw thread

124 is an interior screw thread that is formed on the interior surface of the lateral face 123 of the protective housing 102. The exterior screw thread 134 of the pedestal 132 of the tapered prism structure 111 screws into the interior screw thread 124 to form a threaded connection. The threaded connection formed by the interior screw thread 124 and the exterior screw thread 134 secures the brush structure 101 within the protective housing 102.

The following definitions were used in this disclosure.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barrier: As used in this disclosure, a barrier is a physical obstacle that forms a boundary between a first space and a second space. The barrier prevents the passage of an object between the first space and the second space.

Bimodal Flexible Structure: As used in this disclosure, a bimodal flexible structure is a structure that: a) responds to forces that are applied to one or more dimensional axes of the bimodal flexible structure in the manner of a rigid structure; while, b) simultaneously responding to forces that are applied to a dimensional axis that is perpendicular to the one or more dimensional axes described in (a) in the manner of a semi-rigid structure with an inelastic nature. A conduit structure is an example of a bimodal flexible structure. Specifically, a conduit structure acts as a rigid structure to forces that are applied in a radial direction towards the center axis of the prism structure of the conduit structure while being allowing the prism structure of the conduit to bend such that the conduit can be shaped into a non-Euclidean prism. A drafting spline is another example of a bimodal flexible structure. The resistance of a wire to compressive forces along the center axis of the wire allows a wire to behave as a bimodal flexible structure.

Bristle: As used in this disclosure, a bristle is a short coarse stiff hair or hair like object.

Brush: As used in this disclosure, a brush is a device comprising a plurality of bristles set into a handle or a base that is used for grooming, sweeping, smoothing, scrubbing, or painting.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove dirt and detritus from a surface.

Colloidal Suspension: As used in this disclosure, a colloidal suspension, or colloid for short, is a heterogeneous mixture of solute particles dissolved in a solvent. The colloidal suspension is referred to as heterogeneous because the distribution of the solute particles is not uniform through the solvent, usually because of the relatively large size of the particles. When the solvent is a gas, a colloidal suspension is often referred to as an aerosol.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detritus: As used in this disclosure, detritus refers to plaque, calculus, and stains that accrete on a tooth.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Disposable: As used in this disclosure, an object is disposable if the object is not reusable.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Liquid: As used in this disclosure, a liquid refers to a state (phase) of matter that is fluid and that maintains, for a given pressure, a fixed volume that is independent of the volume of the container.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein an axis of the structure lies on a non-Euclidean plane or is otherwise formed with a curvature.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Paste: As used in this disclosure, a paste is a viscous colloidal material with a viscosity that allows the paste to be treated as a malleable solid.

Patient: As used in this disclosure, a patient is a person who is designated to receive a medical treatment, therapy or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Piston: As used in this disclosure, a piston is a prism or disk that closely fits within a pipe or tube and that moves along the center axis of the pipe or tube. Depending on the context, a piston can also refer to the apparatus associated with the disk that allows the disk to move within the pipe or tube.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; or, b) maintains an environment suitable within the protected space that is appropriate for the object.

Reach: As used in this disclosure, reach refers to a span of distance between any two objects.

Rim: As used in this disclosure, a rim is an outer edge or border that follows along the perimeter of an object.

Solid: As used in this disclosure, a solid refers to a state (phase) of matter that: 1) has a fixed volume; and, 2) does not flow.

Spline: As used in this disclosure, a spline is a prism-shaped negative space that is formed in an object. The spline receives, or guides the motion of, a second prism or disk-shaped object that inserts into the negative space formed by the spline.

Taper: As used in this disclosure, a taper is a continuous and typically, but not necessarily gradual, change in the span of the length of a structure in the direction parallel a direction selected from the group selected from the major axis and the minor axis of the structure. The change in the span of the length occurs as an apparent function of the measurement position along the unselected axis of the object.

Tapered Prism Structure: As used in this disclosure, a tapered prism structure is a modified prism structure that is formed such that the first congruent end of the modified prism structure is geometrically similar to, but not geometrically identical to the second congruent end of the modified prism. The span of length of a radial line (the radial radius) from the center axis to the lateral face of the modified prism structure will vary as a function of its position along the center axis.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tight Fit: As used in this disclosure, a tight fit refers to the insertion of a first object into a second object such that there is not a lot of space between the first object and the second object.

Toothbrush: As used in this disclosure, a toothbrush is a brush that is used to clean the teeth of a patient.

Toothpaste: As used in this disclosure, toothpaste is an abrasive material used to clean the detritus off of the teeth of an individual. Toothpaste typically is a solid phase material commonly referred to as a paste or a gel.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Viscosity: As used in this disclosure, viscosity refers to the resistance of a liquid or an elastic material to deformation. Higher viscosity would refer to a greater resistance to flow or to deformation.

Viscous: As used in this disclosure, a viscous material is a material with a viscosity such that the viscous material has characteristics intermediate between a liquid and a solid.

Viscous Colloid: As used in this disclosure, a viscous colloid is a colloidal suspension where the viscosity or flow rate of the colloid is such that the colloid will flow but can for all practical purposes be treated and contained as if it were a solid. In common usages, a viscous colloid is often referred to as a cream or a paste.

Worm Drive: As used in this disclosure, a worm drive refers to a mechanical arrangement where a rotating cylinder further comprising an exterior screw thread is used to: 1) rotate a gear; or 2) move a plate formed with an interior screw thread in a linear fashion in the direction of the center axis of the rotating cylinder. Worm drives are also referred to as worm gears.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A disposable toothpaste-dispensing toothbrush comprising a brush structure and a protective housing;

wherein the protective housing encloses the brush structure;

wherein the disposable toothpaste-dispensing toothbrush is a toothbrush;

wherein the disposable toothpaste-dispensing toothbrush is a disposable structure;

wherein the disposable toothpaste-dispensing toothbrush contains a toothpaste;

wherein the disposable toothpaste-dispensing toothbrush dispenses the toothpaste before the use of the disposable toothpaste-dispensing toothbrush;

wherein the brush structure comprises a tapered structure, an extension structure, a spline, a worm drive mounted in the tapered structure, and the toothpaste wherein the spline is a non-Euclidean tubular structure;

wherein the spline comprises a brush head aperture and a worm drive aperture;

wherein the brush head aperture forms an open end of the non-Euclidean tubular structure of the spline;

wherein the brush head aperture forms a port through which the toothpaste is discharged from the spline by the worm drive;

wherein the worm drive aperture forms an open end of the non-Euclidean tubular structure of the spline;

wherein the worm drive aperture forms a port that allows a drive shaft to insert into the spline;

wherein the worm drive aperture is sized such that the drive shaft can move linearly into and out of a negative space formed by the spline.

2. The disposable toothpaste-dispensing toothbrush according to claim 1 wherein the brush structure is a mechanical structure;

wherein the brush structure has a composite structure;

wherein the brush structure stores the toothpaste;

wherein the brush structure dispenses the toothpaste;

wherein the brush structure forms an abrasive structure.

3. The disposable toothpaste-dispensing toothbrush according to claim 2 wherein the extension structure attaches to the tapered structure to form the composite structure;

wherein the tapered structure contains a portion of the spline;

wherein the extension structure contains a portion of the spline.

4. The disposable toothpaste-dispensing toothbrush according to claim 3 wherein the tapered structure is a mechanical structure;

wherein the tapered structure is a hollow structure;

wherein the tapered structure forms a grip used to hold and manipulate the brush structure.

5. The disposable toothpaste-dispensing toothbrush according to claim 4 wherein the extension structure attaches to a congruent end of the tapered structure with a lesser radial diameter;

wherein the extension structure presents a brush head;

wherein the extension structure forms a reach between the tapered structure and the brush head.

6. The disposable toothpaste-dispensing toothbrush according to claim 5 wherein the spline is formed in the interiors of both the tapered structure and the extension structure;

wherein the spline is a non-Euclidean structure;

wherein the spline forms a non-Euclidean tubular structure that stores the toothpaste within the brush structure;

wherein the spline transports the toothpaste to the brush head of the extension structure;

wherein the spline discharges the toothpaste into the brush head.

7. The disposable toothpaste-dispensing toothbrush according to claim 6 wherein the worm drive is a mechanical structure;

wherein the worm drive converts rotational motion into linear motion;

wherein the worm drive provides motive forces that push the toothpaste out of the spline into the brush head.

8. The disposable toothpaste-dispensing toothbrush according to claim 7 wherein the tapered structure comprises a worm drive cylinder, a pedestal, and a dial;

wherein the pedestal attaches the dial to the tapered structure;

wherein the worm drive cylinder is formed in the tapered structure.

9. The disposable toothpaste-dispensing toothbrush according to claim 8 wherein the extension structure comprises the brush head;

wherein the brush head is a brush;

wherein the brush head attaches to an exterior of the extension structure;

wherein the position of the brush head is at a location that is distal from the tapered structure of the brush structure;

wherein the brush head forms the abrasive structure.

10. The disposable toothpaste-dispensing toothbrush according to claim 9 wherein the worm drive comprises the drive shaft and a piston;

wherein the piston attaches to the worm drive.

11. The disposable toothpaste-dispensing toothbrush according to claim 10 wherein the worm drive cylinder is a negative space that is formed in the tapered structure;

wherein the worm drive cylinder contains the worm drive within the tapered structure.

12. The disposable toothpaste-dispensing toothbrush according to claim 11 wherein the pedestal is a rim structure;

wherein the pedestal is formed at a congruent end of the tapered structure with a greater radial diameter;

wherein the pedestal forms a stable base;

wherein the pedestal further comprises an exterior screw thread;

wherein the exterior screw thread is a helical structure that is formed on an exterior surface of the pedestal;

wherein the exterior screw thread secures the brush structure into the protective housing.

13. The disposable toothpaste-dispensing toothbrush according to claim 12 wherein the dial is a rotating structure;

wherein the dial attaches to the pedestal such that the dial rotates relative to the pedestal;

wherein the dial physically attaches to the worm drive such that the rotation of the dial rotates the worm drive.

14. The disposable toothpaste-dispensing toothbrush according to claim 13 wherein the drive shaft forms a shaft that physically connects to the worm drive;

wherein the rotation of the worm drive by the dial of the tapered structure generates a linear motion that moves the drive shaft into and out of the spline;

wherein the drive shaft inserts into the spline such that the center axes of the drive shaft and the spline are aligned.

15. The disposable toothpaste-dispensing toothbrush according to claim 14 wherein the drive shaft is formed as a bimodal flexible structure that allows the drive shaft to: a) transfer a motive force to the piston; while, b) simultaneously allowing a center axis of the drive shaft to adjust to changes in the center axis of the non-Euclidean structure of the spline.

16. The disposable toothpaste-dispensing toothbrush according to claim 15 wherein the piston is a disk-shaped structure;

wherein the piston is a rigid structure;

wherein the piston attaches to a congruent end of the drive shaft that is distal from the worm drive;

wherein the piston and the worm drive join to form a composite structure;

wherein the piston is geometrically similar to the spline;

wherein a face of the disk structure of the piston inserts into the spline such that congruent ends of the disk structure of the piston are perpendicular to a center axis of the spline;

wherein the piston is formed such that there is a tight fit between the piston and interior walls of the spline.

17. The disposable toothpaste-dispensing toothbrush according to claim 16 wherein the protective housing is a mechanical structure;

wherein the protective housing forms a protected space used to enclose the brush head of the brush structure;

wherein the protective housing has a tube structure;

wherein the protective housing has a pan structure.

18. The disposable toothpaste-dispensing toothbrush according to claim 17 wherein the protective housing comprises an open congruent end, a closed congruent end, and a lateral face;

wherein the open congruent end is an open end of the pan structure of the protective housing;

wherein the open congruent end is sized such that the brush structure fully inserts into the protective housing through the open congruent end;

wherein the closed congruent end is a closed end of the pan structure of the protective housing;

wherein the closed congruent end forms a containment boundary of the pan structure of the protective housing;

wherein the closed congruent end is an end of the protective housing that is distal from the open congruent end;

wherein the lateral face is a lateral face of the pan structure of the protective housing;

wherein the lateral face forms a containment boundary of the pan structure of the protective housing;

wherein the brush structure inserts into the open congruent end of the pan structure of the protective housing for storage.

19. The disposable toothpaste-dispensing toothbrush according to claim 18 wherein the lateral face further comprises an interior screw thread;

wherein the interior screw thread is an interior screw thread that is formed on an interior surface of the lateral face of the protective housing;

wherein the exterior screw thread of the pedestal of the tapered structure screws into the interior screw thread to form a threaded connection;

wherein the threaded connection formed by the interior screw thread and the exterior screw thread secures the brush structure within the protective housing.

* * * * *